US010562330B2

(12) United States Patent
Nishitani et al.

(10) Patent No.: US 10,562,330 B2
(45) Date of Patent: Feb. 18, 2020

(54) PRINTING APPARATUS AND PRINTING METHOD

(71) Applicant: CANON KABUSHIKI KAISHA, Tokyo (JP)

(72) Inventors: Eisuke Nishitani, Tokyo (JP); Masaki Nitta, Yokohama (JP); Yoshiaki Murayama, Tokyo (JP); Keiichirou Takeuchi, Komae (JP); Rinako Kameshima, Tachikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/165,808

(22) Filed: Oct. 19, 2018

(65) Prior Publication Data

US 2019/0126654 A1 May 2, 2019

(30) Foreign Application Priority Data

Oct. 27, 2017 (JP) ..... 2017-207961

(51) Int. Cl.

| | |
|---|---|
| ***B41M 5/00*** | (2006.01) |
| ***B41M 3/00*** | (2006.01) |
| ***B41J 11/00*** | (2006.01) |
| ***B41J 29/393*** | (2006.01) |
| ***B41M 5/025*** | (2006.01) |
| ***B41J 29/38*** | (2006.01) |
| *B41J 2/01* | (2006.01) |

(52) U.S. Cl.

CPC ..... *B41M 3/001* (2013.01); *B41J 11/0015* (2013.01); *B41J 29/38* (2013.01); *B41J 29/393* (2013.01); *B41M 5/0017* (2013.01); *B41M 5/0256* (2013.01); *B41J 2002/012* (2013.01); *B41J 2029/3935* (2013.01); *B41M 2205/24* (2013.01)

(58) Field of Classification Search

CPC .. B41M 3/001; B41M 5/0017; B41M 5/0256; B41M 2205/24; B41J 29/38; B41J 29/393; B41J 11/0015; B41J 2002/012; B41J 2029/3935

See application file for complete search history.

(56) References Cited

U.S. PATENT DOCUMENTS

2011/0018925 A1* 1/2011 Ohara ..... B41J 2/0057 347/16
2011/0310140 A1* 12/2011 Tonohiro ..... B41J 11/0015 347/6
2011/0316925 A1* 12/2011 Saita ..... B41J 2/2142 347/19

FOREIGN PATENT DOCUMENTS

JP 2009045851 A 3/2009

* cited by examiner

*Primary Examiner* — Yaovi M Ameh

(74) *Attorney, Agent, or Firm* — Canon U.S.A., Inc. IP Division

(57) ABSTRACT

A printing mode for performing printing to a printing medium and a determination mode for determining the application amount of a reaction liquid to a discharge medium can be performed. In the determination mode, a reaction liquid application unit forms a layer of the reaction liquid on the discharge medium, and then an ink application unit applies an ink onto a part of the layer to form a test pattern to be utilized for the determination. In the formation of the test pattern, an image to be formed by the ink by the aggregation of a solid content in the applied ink partially moves and shrinks on the layer of the reaction liquid to be thereby deformed with a grade according to the applied reaction liquid.

10 Claims, 10 Drawing Sheets

PRINTING APPARATUS AND PRINTING METHOD

BACKGROUND OF THE DISCLOSURE

Field of the Disclosure

The disclosure relates to a printing apparatus and a printing method.

Description of the Related Art

As a printing method using an ink jet system, a method is known which uses a reaction liquid aggregating components of an ink containing a coloring material component on a medium. Japanese Patent Laid-Open No. 2009-45851 discloses a method including forming an intermediate image with an ink jet system on a transfer body to which a reaction liquid aggregating a coloring material in an ink is applied, and then transferring the intermediate image to a printing medium.

In order to prevent the blurring of an ink by an aggregation reaction, a sufficient amount of a reaction liquid needs to be applied. On the other hand, according to an examination of the present inventors, it has been found that, when the application amount of the reaction liquid to a medium is excessively large, an ink image formed by the ink moves on the reaction liquid in some cases.

SUMMARY OF THE DISCLOSURE

The disclosure has been made in view of the above-described problem. It is an aspect of the disclosure to detect with good accuracy that the application amount of a reaction liquid to a medium is excessive.

According to the disclosure, a printing apparatus has a reaction liquid application unit applying a reaction liquid onto a discharge medium, an ink application unit applying an ink containing a solid content to be aggregated by reacting with the reaction liquid onto the reaction liquid applied onto the discharge medium, and an adjustment unit adjusting the amount of the reaction liquid to be applied to the discharge medium by the application unit, in which, in order to adjust the amount of the reaction liquid to be applied to the discharge medium using the adjustment unit, a determination mode for determining the application amount of the reaction liquid onto the discharge medium is performed, in the determination mode, the reaction liquid application unit forms a layer of the reaction liquid on the discharge medium, and then the ink application unit applied the ink onto a part of the layer to form a test pattern to be utilized for the determination, and, in the formation of the test pattern, an image formed by the ink by aggregation of the solid content in the applied ink partially moves and shrinks on the layer of the reaction liquid, whereby the image is deformed with a degree corresponding to the amount of the reaction liquid in the layer of the reaction liquid.

Further features and aspects of the disclosure will become apparent from the following description of numerous example embodiments with reference to the attached drawings.

DESCRIPTION OF THE EMBODIMENTS

Hereinafter, the disclosure is described in detail with reference to suitable embodiments.

Hereinafter, an ink jet printing apparatus as an example of a printing apparatus according to an embodiment is described with reference to the drawings.

As the ink jet printing apparatus, an ink jet printing apparatus is mentioned which includes discharging an ink onto a transfer body as a discharge medium to form an ink image, and then transferring the ink image after liquid is removed from the ink image by a liquid absorbing member to a printing medium. In addition thereto, an ink jet printing apparatus is mentioned which includes forming an ink image on a printing medium, such as paper or cloth, as a discharge medium, and then removing liquid by a liquid absorbing member from the ink image on the printing medium. In the disclosure, the former ink jet printing apparatus is referred to as a transfer type ink jet printing apparatus below for convenience and the latter ink jet printing apparatus is referred to as a direct drawing type ink jet printing apparatus below for convenience.

Hereinafter, each ink jet printing apparatus is described.

Example Transfer Type Ink Jet Printing Apparatus

Figure 1:
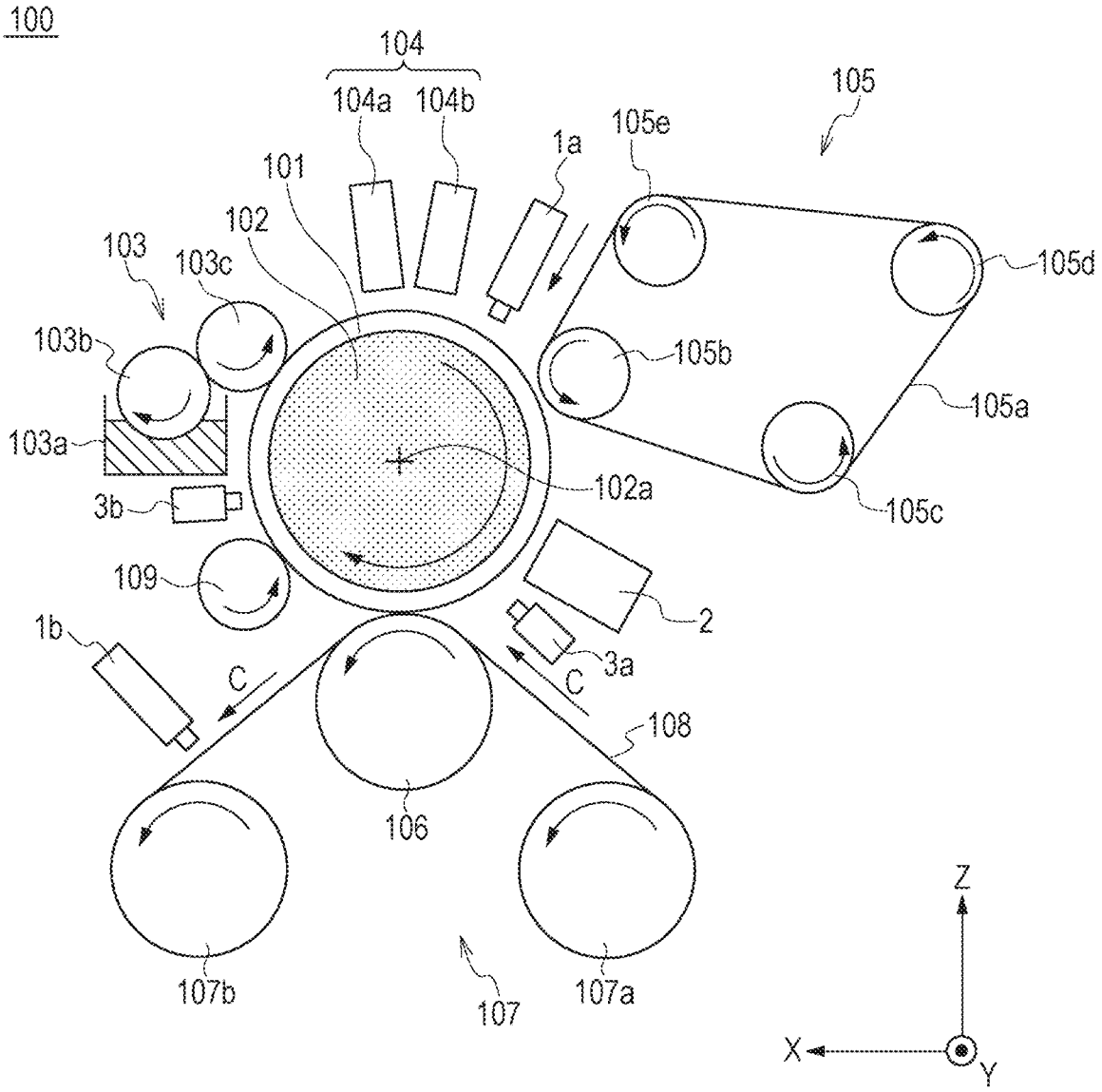
FIG. 1 is a schematic view illustrating an example of the configuration of a transfer type ink jet printing apparatus according to one embodiment of the disclosure.

FIG. 1 is a schematic view illustrating an example of the schematic configuration of a transfer type ink jet printing apparatus 100 of this embodiment. The printing apparatus is a sheet type ink jet printing apparatus producing printed matter by transferring an ink image to a printing medium 108 through a transfer body 101. In this embodiment, the X direction, the Y direction, and the Z direction indicate the width direction (total length direction), the depth direction, and the height direction, respectively, of the transfer type ink jet printing apparatus 100. A printing medium 108 is conveyed in the X direction but is sometimes conveyed with an inclination from the X direction as indicated by an arrow C in the figure during the conveyance.

The transfer type ink jet printing apparatus 100 of the disclosure has a transfer body 101 supported by a support member 102 and a reaction liquid application device 103 applying a reaction liquid reacting with a color ink onto the transfer body 101 as illustrated in FIG. 1. Moreover, an ink application device 104 having an ink jet head applying a colored ink onto the transfer body 101 to which the reaction liquid is applied to form an ink image which is an image with the ink on the transfer body 101 and a liquid removing device 105 removing a liquid component from the ink image on the transfer body 101 are provided. Furthermore, a heating device 2 heating the ink image after the liquid absorption and a pressing member 106 for transfer for transferring the ink image from which a liquid component is removed on the transfer body 101 onto a printing medium 108, such as paper, are provided. Moreover, the transfer type ink jet printing apparatus 100 may have a transfer body cleaning member 109 cleaning the surface of the transfer body 101 after the transfer as necessary. It is a matter of course that the transfer body 101, the reaction liquid application device 103, the ink jet head of the ink application device 104, the liquid removing device 105, and the transfer body cleaning member 109 each have a length corresponding to the printing medium 108 to be used in the Y direction.

The transfer body 101 rotates in the direction as indicated by an arrow A of FIG. 1 around a rotation shaft 102a of the support member 102. The transfer body 101 moves by the rotation of the support member 102. Onto the moving transfer body 101, a reaction liquid is applied by the reaction liquid application device 103 and an ink is applied by the ink application device 104 in a sequential manner, so that an ink image is formed on the transfer body 101. The ink image formed on the transfer body 101 is moved to a position where the ink image contacts a liquid absorbing member 105*a* provided in the liquid removing device 105 by the movement of the transfer body 101.

The transfer body 101 and the liquid removing device 105 move in synchronization with the rotation of the transfer body 101. The ink image formed on the transfer body 101 passes through a state of contacting the moving liquid absorbing member 105*a*. In the meantime, the liquid absorbing member 105*a* removes a liquid component from the ink image on the transfer body 101. In the contact state, the liquid absorbing member 105*a* can be pressed against the transfer body 101 with predetermined pressing force so as to effectively operate the liquid absorbing member 105*a*.

When described from a different viewpoint, the removal of the liquid component can also be expressed as "concentrating the ink configuring the image formed on the transfer body". The concentration of the ink means that the content ratio of solid contents, such as coloring materials and resin, contained in the ink to the liquid component increases with a reduction in the liquid component contained in the ink.

The ink image after the liquid absorption from which the liquid component is removed is in a state where the ink is concentrated as compared with the ink image before the liquid absorption, and further moved to a transfer portion contacting the printing medium 108, which is conveyed by a printing medium conveying device 107, by the transfer body 101. By the pressing of the transfer body 101 by the pressing member 106 while the ink image after the liquid absorption contacts the printing medium 108, the ink image is transferred onto the printing medium 108. The ink image after the transfer transferred onto the printing medium 108 are reverse images of the ink image before the liquid absorption and the ink image after the liquid absorption.

In this embodiment, the reaction liquid is applied onto the transfer body, and then the ink is applied, so that an image is formed, and therefore the reaction liquid does not react with the ink and remains in a non-image region where the image with the ink is not formed. With this apparatus, the liquid absorbing member 105*a* removes not only the liquid component from the image but the liquid component of the reaction liquid by contacting the unreacted reaction liquid.

Therefore, in the description above, the expression and the description that the liquid component is removed from the image are not limited to the meaning of removing the liquid component only from the image and mean that the liquid component may be removed at least from the image on the transfer body.

The liquid component is not particularly limited insofar as it does not have a fixed shape, has flowability, and has an almost constant volume.

For example, water, an organic solvent, and the like contained in the ink or the reaction liquid are mentioned as the liquid component.

Each configuration of the transfer type ink jet printing apparatus 100 of this embodiment is described below.

Example Transfer Body

The transfer body 101 has a surface layer containing an image formation surface. As components of the surface layer, various materials, such as resin and ceramics, can be used as appropriate and materials with a high modulus of compression can be used in terms of durability and the like. Specifically, an acrylic resin, an acrylic silicone resin, a fluorine containing resin, a condensate obtained by condensing a hydrolytic organosilicon compound, and the like are mentioned. In order to increase the wettability, transferability, and the like of the reaction liquid, surface treatment may be performed. Examples of the surface treatment include flame treatment, corona treatment, plasma treatment, polishing treatment, roughing treatment, active energy ray irradiation treatment, ozone treatment, surfactant treatment, silane coupling treatment, and the like. The treatment may be used in combination of two or more kinds thereof. An arbitrary surface shape can also be provided to the surface layer.

The transfer body can have a compression layer having a function of absorbing pressure fluctuations. By providing the compression layer, the compression layer can absorb deformation and disperse the fluctuation of a local pressure fluctuation, and thus good transferability can be maintained also in high speed printing. Examples of components of the compression layer include acrylonitrile-butadiene rubber, acrylic rubber, chloroprene rubber, urethane rubber, silicone rubber, and the like, for example. Those which are made porous by compounding a predetermined amount of a vulcanizing agent, a vulcanization accelerator, and the like, and further compounding a foaming agent and a filler, such as hollow particles or a common salt, as necessary in the molding of rubber materials can be used. Thus, bubble portions are compressed with volume changes to various pressure fluctuations, and therefore the deformation in directions other than the compression direction is small, and thus more stable transferability and durability can be obtained. As porous rubber materials, those having a continuation pore structure in which the pores are connected to each other and those having an independent pore structure in which the pores are independent from each other are mentioned. In the disclosure, both the structures may be acceptable and the structures may be used in combination.

The transfer body can further have an elastic layer between the surface layer and the compression layer. As components of the elastic layer, various materials, such as resin and ceramics, can be used as appropriate. In terms of the processing characteristics and the like, various elastomer materials and rubber materials can be used. Specific examples include, for example, fluorosilicone rubber, phenyl silicone rubber, fluororubber, chloroprene rubber, urethane rubber, nitrile rubber, ethylene propylene rubber, and natural rubber. Moreover, styrene rubber, isoprene rubber, butadiene rubber, a copolymer of ethylene/propylene/butadiene, nitrile butadiene rubber, and the like are mentioned. In particular, the silicone rubber, the fluorosilicone rubber, and the phenylsilicone rubber have low small compression set, and thus are suitable in terms of dimensional stability and durability. Moreover, the rubber has a low elastic modulus change due to temperatures and is suitable also in terms of transferability.

Between the layers (surface layer, elastic layer, compression layer) configuring the transfer body, various adhesives or a double-sided tape may be used in order to fix and hold the layers. Moreover, a reinforcing layer with a high modulus of compression may be provided in order to suppress transverse elongation when attached to the apparatus or maintain stiffness. Woven fabrics may be used as the reinforcing layer. The transfer body can be produced by arbitrarily combining the layers containing the materials mentioned above.

The size of the transfer body can be freely selected according to the size of a target image to be printed. The shape of the transfer body is not particularly limited and a sheet shape, a roller shape, a belt shape, an endless web shape, and the like are specifically mentioned.

Example Support Member

The transfer body 101 is supported on the support member 102. As a method for supporting the transfer body 101, various adhesives or a double-sided tape may be used. Or, an installation member containing metals, ceramics, resin, and the like as a material may be attached to the transfer body 101 so that the transfer body 101 may be supported on the support member 102 using the installation member.

The support member 102 is required to have a certain degree of structural strength from the viewpoint of the conveyance accuracy or durability thereof. For the materials of the support member 102, metals, ceramics, resin, and the like can be used. Among the above, in order to improve not only the rigidity to withstand the pressurization in transfer or the dimensional accuracy but the responsiveness of the control by reducing the inertia in the operation, aluminum, iron, stainless steel, acetal resin, and epoxy resin can be used. In addition thereto, polyimide, polyethylene, polyethylene terephthalate, nylon, polyurethane, silica ceramics, and alumina ceramics can be used. The materials can also be used in combination.

Example Reaction Liquid Application Device

The ink jet printing apparatus 100 of this embodiment has the reaction liquid application device 103 applying a reaction liquid to the transfer body 101. The reaction liquid can contact an ink to thereby reduce the flowability of the ink and/or some of ink compositions on a discharge medium to suppress bleeding or beading in the image formation by the ink. Specifically, a reaction agent (also referred to as "ink viscosity increasing component) contained in the reaction liquid contacts a coloring material, resin, and the like which are some of compositions configuring the ink to thereby chemically react with the same or physically adsorbs to the same. Thus, an increase in the viscosity of the entire ink and a local increase in the viscosity due to the aggregation of some of components configuring the ink, such as a coloring material, can be caused, so that the flowability of the ink and/or some of the ink compositions can be reduced. FIG. 1 illustrates a case where the reaction liquid application device 103 is a gravure offset roller having a reaction liquid storage portion 103*a* storing a reaction liquid and reaction liquid application members 103*b* and 103*c* applying the reaction liquid in the reaction liquid storage portion 103*a* onto the transfer body 101.

The reaction liquid application device 103 may be any device insofar as a reaction liquid can be applied onto a discharge medium and various devices known heretofore can be used as appropriate. Specifically, a gravure offset roller, an ink jet head, a die coating device (die coater), a blade coating device (blade coater), and the like are mentioned. The application of the reaction liquid by the reaction liquid application device 103 may be performed before the application of an ink or may be performed after the application of an ink insofar as the reaction liquid can be mixed (reacted) with the ink on a discharge medium. The reaction liquid can be applied before the application of an ink. By applying the reaction liquid before the application of an ink, bleeding in which inks applied to be adjacent to each other are mixed or beading in which an ink landing before is attracted to an ink landing later in image printing by an ink jet system can also be prevented.

Example Reaction Liquid

Hereinafter, each component configuring the reaction liquid applied to this embodiment is described in detail.

Example Reaction Agent

The reaction liquid aggregates components (resin, self-dispersible pigments, and the like) having an anionic group in an ink aggregate by contacting the ink and contains a reaction agent. As the reaction agent, cationic components, such as polyvalent metal ions and cationic resin, organic acids, and the like can be mentioned, for example.

Examples of the polyvalent metal ions include divalent metal ions, such as $Ca^{2+}$, $Cu^{2+}$, $Ni^{2+}$, $Mg^{2+}$, $Sr^{2+}$, $Ba^{2+}$, and $Zn^{2+}$, and tervalent metal ions, such as $Fe^{3+}$, $Cr^{3+}$, $Y^{3+}$, $Al^{3+}$, for example. In order to compound the polyvalent metal ions in the reaction liquid, polyvalent metal salts (which may be hydrates) formed by bonding between the polyvalent metal ions and anions are usable. Examples of the anions include $Cl^-$, $Br^-$, $I^-$, $ClO^-$, $ClO_2^-$, $ClO_3^-$, $ClO_4^-$, $NO_2^-$, $NO_3^-$, $SO_4^{2-}$, $CO_3^{2-}$, $HCO_3^-$, $PO_4^{3-}$, and $HPO_4^{2-}$, for example. Moreover, inorganic anions, such as $H_2PO^{4-}$, and organic anions, such as $HCOO^-$, $(COO^-)_2$, $COOH(COO^-)$, $CH_3COO^-$, $C_2H_4(COO^-)_2$, $C_6H_5COO^-$, $C_6H_4(COO^-)_2$, and $CH_3SO_3^-$, can be mentioned. When the polyvalent metal ions are used as the reaction agent, the content (% by mass) in terms of the polyvalent metal salts in the reaction liquid is preferably 1.00% by mass or more and 20.00% by mass based on the total mass of the reaction liquid.

The reaction liquid containing organic acids have buffering capacity in an acidic region (less than pH 7.0 and preferably pH 2.0 to 5.0), and thus converts anionic groups of components present in an ink into an acid type, and then aggregates the components. Examples of the organic acids include formic acid, acetic acid, propionic acid, butyric acid, benzoic acid, glycolic acid, lactic acid, salicylic acid, pyrrole carboxylic acid, furancarboxylic acid, picolinic acid, nicotinic acid, and thiophene carboxylic acid, for example. Moreover, monocarboxylic acids, such as levulinic acid and coumaric acid, and salts thereof; dicarboxylic acids, such as oxalic acid, malonic acid, succinic acid, glutaric acid, adipic acid, maleic acid, fumaric acid, itaconic acid, sebacic acid, phthalic acid, malic acid, and tartaric acid, and salts thereof or hydrogen salts thereof can be mentioned. Moreover, tricarboxylic acids, such as citric acid and trimellitic acid, and salts thereof or hydrogen salts thereof; tetracarboxylic acids, such as pyromellitic acid, and salts thereof or hydrogen salts thereof; and the like can be mentioned. The content (% by mass) of the organic acids in the reaction liquid is preferably 1.00% by mass or more and 50.00% by mass.

As the cationic resin, resins having primary to tertiary amine structures, resins having a quaternary ammonium salt structure, and the like can be mentioned, for example. Specifically, resins having structures of vinyl amine, allylamine, vinyl imidazole, vinyl pyridine, dimethyl aminoethyl methacrylate, ethylene imine, guanidinem and the like can be mentioned. In order to improve the solubility in the reaction liquid, the cationic resins and the acidic compounds can be used in combination or the cationic resins can also be quaternized. When the cationic resins are used as the reaction agent, the content (% by mass) of the cationic resins in the reaction liquid is preferably 1.00% by mass or more and 10.00% by mass or less based on the total mass of the reaction liquid.

Example Components Other Than Reaction Agent

As components other than the reaction agent, substances similar to aqueous media, other additives, and the like described later are usable as substances usable in ink. Ink application device The ink jet printing apparatus of this embodiment has the ink application device 104 applying an ink to the transfer body 101. In FIG. 1, the reaction liquid and an ink are mixed, so that an ink image is formed by the reaction liquid and the ink on the transfer body 101, and further a liquid component is removed from the ink image by the liquid removing device 105.

In this embodiment, an ink jet head is used as the ink application device 104 applying an ink. FIG. 1 illustrates an ink jet head 104a for a first color and an ink jet head 104b for a second color different from the first color and ink jet heads for the other colors can be disposed side by side in the X direction to be utilized. As the ink jet head, a mode for causing film boiling in an ink by electrothermal converter to form bubbles to thereby discharge the ink, a mode for discharging an ink by an electromechanical converter, a mode for discharging an ink utilizing static electricity, and the like are mentioned, for example. In this embodiment, known ink jet heads are usable. In particular, from the viewpoint of high density printing at a high speed, one utilizing an electrothermal converter can be used. In the drawing, a required amount of an ink is applied to each position by receiving an image signal.

In this embodiment, the ink jet heads form a full line head disposed so as to extend in the Y direction and nozzles are arranged in a range covering a portion corresponding to the width of an image printing region of a printing medium of the maximum usable size. Each ink jet head has an ink discharge surface in which the nozzle is opened to the undersurface (transfer body 101 side). The ink discharge surface faces the surface of the transfer body 101 with a minute gap (about several millimeters).

The ink application amount can be expressed by the density value of image data, the ink thickness, or the like but, in this embodiment, the average value obtained by multiplying the mass of each ink dot by the number of applied dots, and then dividing the obtained number by the printing area is defined as the ink application amount ($g/m^2$). The maximum ink application amount in the image region indicates the ink application amount applied in an area of at least 5 $mm^2$ or more in a region used as information on a discharge medium from the viewpoint of removing the liquid component in the ink.

The ink application device 104 may have a plurality of ink jet heads in order to apply color inks of various colors onto a discharge medium. For example, when color images are formed using a yellow ink, a magenta ink, a cyan ink, and a black ink, the ink application device has four ink jet heads individually discharging the four kinds of inks mentioned above onto a discharge medium. The ink jet heads are disposed side by side in the X direction.

The ink application device may contain an ink jet head discharging a clear ink which contains no coloring materials or which contains the coloring materials in a very low proportion, even if contained, and thus is substantially transparent. The clear ink can be utilized in order to form an ink image together with the reaction liquid and the color inks. For example, the clear ink is usable in order to increase the glossiness of an image. A resin component to be compounded may be adjusted as appropriate and further the discharge position of the clear ink may be controlled so that an image after transfer brings about a glossy feeling. It is desirable that the clear ink is located on the top layer side relative to the color inks in final printed matter, and therefore the clear ink is applied onto the transfer body 101 before the color inks in the transfer type printing apparatus. Therefore, in the movement direction of the transfer body 101 facing the ink application device 104, the ink jet head for the clear ink can be disposed on the upstream side relative to the ink jet heads for the color inks.

The clear ink can be utilized not only in order to improve the glossiness but in order to improve the transferability of an image from the transfer body 101 to the printing medium 108. For example, a large amount of a component revealing adhesiveness is compounded in the clear ink as compared with the color inks, and then the clear ink is applied to the color inks, whereby the clear ink can be utilized as a transferability improvement liquid to be applied onto the transfer body 101. For example, in the movement direction of the transfer body 101 facing the ink application device 104, an ink jet head for the clear ink for improving the transferability is disposed on the downstream side relative to the ink jet heads for the color inks. Then, the color inks are applied to the transfer body 101, and then the clear ink is applied onto the transfer body after the color inks are applied, whereby the clear ink is present on the outermost surface of an ink image. In the transfer of the ink image to the printing medium 108 in the transfer portion 111, the clear ink on the surface of the ink image adheres to the printing medium 108 with a certain degree of adhesive force, and thus the movement of the ink image after liquid absorption to the printing medium 108 is facilitated.

Example Ink

Hereinafter, each component configuring an ink applied to this embodiment is described in detail.

Example Coloring Material

As the coloring material, pigments or dyes are usable. The content of the coloring material in the ink is preferably 0.5% by mass or more and 15.0% by mass or less and more preferably 1.0% by mass or more and 10.0% by mass or less based on the total ink mass.

As specific examples of the pigments, inorganic pigments, such as carbon black and titanium oxide; and organic pigments, such as azo, phthalocyanine, quinacridone, isoindolinone, imidazolone, diketopyrrolopyrrole, and dioxazine, can be mentioned.

As a dispersion system of the pigments, resin dispersion pigments containing resin as a dispersant, self-dispersible pigments in which a hydrophilic group is bonded to the pigment particle surface, and the like are usable. Moreover, resin bonded pigments in which organic groups including resin are chemically bonded to the pigment particle surface, microcapsule pigments in which the pigment particle surface is covered with resin, for example, and the like are usable.

As a resin dispersant for dispersing pigments into aqueous media, substances capable of dispersing pigments into aqueous media by the action of anionic groups can be used. As the resin dispersant, resin described later can be used and further water-soluble resins can be used. The content (% by mass) of the pigment is preferably 0.3 times or more and 10.0 times or less in terms of the mass ratio of the content of the pigment to the content of the resin dispersant (Pigment/Resin dispersant).

As the self-dispersible pigments, substances in which anionic groups, such as carboxylic acid groups, sulfonic acid groups, and phosphonic acids, are bonded to the pigment particle surface directly or through the other atomic groups (—R—) are usable. The anionic group may be either an acidic type or a salt type. In the case of the salt type, the anionic group may be in a partially dissociated state or in an entirely dissociated state. As cations serving as counterions in the case where the anionic group is the salt type, alkali metal cation; ammonium; organic ammonium; and the like can be mentioned. As specific examples of the other atomic groups (—R—), linear or branched alkylene groups having 1 to 12 carbon atoms; arylene groups, such as a phenylene group and a naphtylene group; carbonyl groups; imino groups; amide groups; sulfonyl groups; ester groups; ether groups, and the like can be mentioned. Moreover, groups obtained by combining the groups may be used.

As the dyes, those having anionic groups may be used. As specific examples of the dyes, dyes, such as azo, triphenylmethane, (aza)phthalocyanine, xanthene, and anthrapyridone, can be mentioned.

Example Resin

Resin can be compounded in the ink. The content (% by mass) of the resin in the ink is preferably 0.1% by mass or more and 20.0% by mass or less and more preferably 0.5% by mass or more and 15.0% by mass or less based on the total ink mass.

The resin can be added to the ink for the reasons of (i) stabilizing the dispersion state of the pigments, i.e., (ii) increasing various characteristics of an image to be printed as the above-described resin dispersant or an auxiliary thereof, and the like. As a form of the resin, a block copolymer, a random copolymer, a graft copolymer, a combination thereof, and the like can be mentioned. The resin may be in a state of being dissolved as a water-soluble resin in an aqueous medium or may be in a state of being dispersed as resin particles in an aqueous medium. The resin particles do not need to include the coloring material.

The description that the resin is water soluble in the disclosure means that, when the resin is neutralized with alkali equivalent to the acid value, particles, the particle diameter of which can be measured by a dynamic light scattering method, are not formed. It can be determined whether the resin is water soluble in accordance with a method described below. First, liquid (Resin solid content: 10% by mass) containing the resin neutralized by the alkali equivalent to the acid value (sodium hydroxide, potassium hydroxide, or the like) is prepared. Subsequently, the prepared liquid is diluted to 10 times (on a volume basis) by pure water to prepare a sample solution. Then, when particles having a particle diameter cannot be measured when the particle diameter of the resin in the sample solution is measured by a dynamic light scattering method, it can be determined that the resin is water soluble. The measurement conditions in this case can be set to as follows: SetZero: 30 seconds, Number of times of measurement: 3 times, and Measuring time: 180 seconds, for example. As a particle size distribution meter, a particle size analyzer (for example, Trade Name "UPA-EX150", manufactured by Nikkiso) by a dynamic light scattering method and the like are usable. It is a matter of course that the particle size distribution meter, the measurement conditions, and the like to be used are not limited to those described above.

The acid value of the resin is preferably 100 mgKOH/g or more and 250 mgKOH/g or less in the case of the water-soluble resin and preferably 5 mgKOH/g or more and 100 mgKOH/g or less in the case of the resin particles. The weight average molecular weight of the resin is preferably 3,000 or more and 15,000 or less in the case of the water-soluble resin and preferably 1,000 or more and 2,000,000 or less in the case of the resin particles. The volume average particle diameter measured by the dynamic light scattering method (The measurement conditions are the same as those above.) of the resin particles is preferably 100 nm or more and 500 nm or less.

As the resin, acrylic resin, urethane-based resin, olefin-based resin, and the like can be mentioned. In particular, the acrylic resin and the urethane-based resin can be used.

As the acrylic resin, those having a hydrophilic unit and a hydrophobic unit as a configuration unit can be used. In particular, resin having a hydrophilic unit derived from (meth)acrylic acid and a hydrophobic unit derived from at least one of a monomer having an aromatic ring and a (meth)acrylic acid ester-based monomer can be used. In particular, resin having a hydrophilic unit derived from (meth)acrylic acid and a hydrophobic unit derived from at least one monomer of styrene and α-methylstyrene can be used. The resins are likely to cause an interaction with the pigments, and therefore can be used as a resin dispersant for dispersing the pigments.

The hydrophilic unit is a unit having hydrophilic groups, such as anionic groups. The hydrophilic unit can be formed by polymerizing hydrophilic monomers having hydrophilic groups, for example. As specific examples of the hydrophilic monomers having hydrophilic groups, acid monomers having carboxylic acid groups, such as (meth)acrylic acid, itaconic acid, maleic acid, and fumaric acid, anionic monomers, such as anhydrides or salts of the acid monomers, and the like can be mentioned. As cations configuring the salts of the acid monomers, ions, such as lithium, sodium, potassium, ammonium, and organic ammonium, can be mentioned. The hydrophobic unit is a unit having no hydrophilic groups, such as anionic groups. The hydrophobic unit can be formed by polymerizing hydrophobic monomers having no hydrophilic groups, such as anionic groups, for example. As specific examples of the hydrophobic monomers, monomers having aromatic rings, such as styrene, α-methylstyrene, and (meth)acrylate benzyl; (meth)acrylic acid ester monomers, such as (meth)acrylate methyl, (meth)acrylate butyl, and (meth)acrylate 2-ethylhexyl, and the like can be mentioned.

The urethane-based resin can be obtained by reacting polyisocyanate with polyol, for example. Moreover, substances obtained by further reacting a chain extender therewith may be acceptable. As the olefin-based resin, polyethylene, polypropylene, and the like can be mentioned, for example.

Example Aqueous Medium

In the Ink, an aqueous medium which is water or a mixed solvent of water and a water-soluble organic solvent can be compounded. As the water, deionized water or ion exchanged water can be used. The content (% by mass) of the water in an aqueous ink is preferably 50.0% by mass or more and 95.0% by mass or less based on the total ink mass.

The content (% by mass) of the water-soluble organic solvent in the aqueous ink is preferably 3.0% by mass or more and 50.0% by mass or less based on the total ink mass. As the water-soluble organic solvent, substances which can be used in an ink jet ink, such as alcohols, (poly)alkylene glycols, glycol ethers, nitrogen containing compounds, and sulfur containing compounds, are all usable.

Other Example Additives

To the ink, various additives, such as an antifoaming agent, a surfactant, a pH adjuster, a viscosity modifier, an antirust, an antiseptic, an antifungal agent, an antioxidant, and a reducing inhibitor, may be compounded as necessary besides the components described above.

Example Liquid Removing Device

In this embodiment, the liquid removing device 105 is a liquid absorbing device absorbing liquid from an ink image on a transfer body. In this embodiment, the liquid removing device 105 has a liquid absorbing member 105*a* and a pressing member 105*b* for liquid absorption pressing the liquid absorbing member 105*a* against an ink image on the transfer body 101. The shapes of the liquid absorbing member 105*a* and the pressing member 105*b* are not particularly limited. For example, a configuration may be acceptable in which the pressing member 105*b* has a columnar shape and the liquid absorbing member 105*a* has a belt shape, and the belt-shaped liquid absorbing member 105*a* is pressed against the transfer body 101 with the columnar pressing member 105*b* as illustrated in FIG. 1. Moreover, a configuration may be acceptable in which the pressing member 105*b* has a columnar shape and the liquid absorbing member 105*a* has a cylindrical shape formed on the peripheral surface of the columnar pressing member 105*b*, and the cylindrical liquid absorbing member 105*a* is pressed against the transfer body 101 with the columnar pressing member 105*b*.

In this embodiment, the liquid absorbing member 105*a* can have a belt shape when space within the ink jet printing apparatus 100 and the like are taken into consideration.

The liquid removing device 105 having the liquid absorbing member 105*a* of such a belt shape may have a stretching member stretching the liquid absorbing member 105*a*. In FIG. 1, the reference numeral 105*c* denotes a stretching roller as the stretching member. In FIG. 1, the pressing member 105*b* is also a roller member rotating in the same manner as the stretching roller but is not limited thereto.

The liquid removing device 105 presses the liquid absorbing member 105*a* having a porous body against an ink image by the pressing member 105*b* to contact the same to thereby cause the liquid absorbing member 105*a* to remove a liquid component contained in the ink image to reduce the liquid component.

As a method for reducing the liquid component in the ink image by the liquid removing device 105, not only the above-described mode for bringing the liquid absorbing member 105*a* into contact with the ink image but various techniques used heretofore, e.g., a method by heating, a method of sending low humidity air, a decompressing method, and the like, may be used. Moreover, in addition to the above-described mode for bringing the liquid absorbing member 105*a* into contact with the ink image, the methods mentioned above may be applied to the ink image after the liquid absorption in which the liquid component is reduced to further reduce the liquid component.

Example Liquid Absorbing Member

In this embodiment, at least one part of the liquid component is removed from the ink image before the liquid absorption by bringing the same into contact with the liquid removing member 105*a* having a porous body to thereby reduce the content of the liquid component in the ink image. The contact surface with the ink image of the liquid removing member 105*a* is defined as a first surface, and a porous body is disposed on the first surface. Such a liquid removing member 105*a* having a porous body can have a shape capable of absorbing liquid while circulating, which moves interlocking with the movement of a discharge medium to contact the ink image, and then re-contacts the ink image before liquid absorption at a predetermined cycle. For example, shapes, such as an endless belt shape and a drum shape, are mentioned.

Example Porous Body

In the porous body of the liquid removing member 105*a* according to this embodiment, one in which the average pore size on the first surface side is smaller than the average pore size on the side of a second surface facing the first surface can be used. In order to prevent the coloring material in the ink from adhering to the porous body, the pore size can be made small and the average pore size of the porous body at least on the first surface side contacting an image is preferably 10 μm or less. In this embodiment, the average pore size indicates the average diameter on the first surface or the second surface and can be measured by known methods, e.g., a mercury penetration method, a nitrogen adsorption method, SEM image observation, and the like.

In order to achieve uniformly high air permeability, the thickness of the porous body can be reduced. The air permeability can be indicated by a Gurley value specified in JIS P8117 and the Gurley value is preferably 10 seconds or less.

However, when the thickness of the porous body is reduced, the capacity required for absorbing the liquid component cannot be sufficiently secured in some cases, and therefore the porous body can be formed into a multilayer configuration. In the liquid removing member 105*a*, a layer contacting the ink image may be a porous body and a layer not contacting the ink image may not be a porous body.

Thus, the ink image from which the liquid component is removed and the liquid component is reduced is formed on the transfer body 101. The ink image after the liquid absorption is next transferred onto the printing medium 108 in the transfer portion 111. The apparatus configuration and the conditions in the transfer are described.

Example Pressing Member for Transfer

In this embodiment, the ink image after the liquid absorption on the transfer body 101 is transferred onto the printing medium 108 conveyed by the printing medium conveying device 107 by bringing the ink image into contact with the printing medium 108 by the pressing member 106 for transfer. After removing the liquid component contained in the ink image on the transfer body 101, the ink image is transferred onto the printing medium 108, whereby a print image with reduced curling, cockling, or the like can be obtained.

The pressing member 106 is demanded to have a certain degree of structural strength from the viewpoint of the conveyance accuracy or durability of the printing medium 108. For materials of the pressing member 106, metals, ceramics, resin, and the like can be used. Among the above, in order to improve not only the rigidity to withstand the pressurization in transfer or the dimensional accuracy but the responsiveness of the control by reducing the inertia in the operation, aluminum, iron, stainless steel, acetal resin, and epoxy resin are used. Moreover, polyimide, polyethylene, polyethylene terephthalate, nylon, polyurethane, silica ceramics, and alumina ceramics can be used. The materials may be used in combination.

The pressing time when the pressing member 106 presses the transfer body 101 in order to transfer the ink image after the liquid absorption on the transfer body 101 to the printing medium 108 is not particularly limited. However, the pressing time is preferably 5 ms or more and 100 ms or less so as to perform good transfer and so as not to impair the durability of the transfer body 101. The pressing time in this embodiment indicates the time when the printing medium 108 and the transfer body 101 are in contact with each other and a value is calculated by performing surface pressure measurement using a surface pressure distribution meter ("I-SCAN", manufactured by Nitta, Corp.), and then dividing the conveyance direction length in a pressurized region by the conveyance speed.

The pressure pressing the transfer body 101 by the pressing member 106 in order to transfer the ink image after the liquid absorption on the transfer body 101 to the printing medium 108 is also not particularly limited and is set so as to perform good transfer and so as not to impair the durability of the transfer body 101. Therefore, the pressure is preferably 9.8 $N/cm^2$ (1 $kg/cm^2$) or more and 294.2 $N/cm^2$ (30 $kg/cm^2$) or less. The pressure in this embodiment indicates the nip pressure between the printing medium 108 and the transfer body 101 and a value is calculated by performing surface pressure measurement using a surface pressure distribution meter, and then dividing the load in a pressurized region by the area.

The temperature when the pressing member 106 presses the transfer body 101 in order to transfer the ink image after the liquid absorption on the transfer body 101 to the printing medium 108 is also not particularly limited and can be equal to or higher than the glass transition point or the softening point of the resin component contained in the ink. An aspect of having a heating unit heating a second image on the transfer body 101, the transfer body 101, and the printing medium 108 can be used for heating.

The shape of the transfer device 106 for transferring is not particularly limited and one having a roller-shape is mentioned, for example.

Example Printing Medium and Printing Medium Conveying Device

In this embodiment, the printing medium 108 is not particularly limited and any known printing medium can be used. Examples of the printing medium include a long substance wound in a roll shape or a sheet-like substance cut into a predetermined size. Examples of materials include paper, a plastic film, a wooden board, corrugated paper, a metal film, and the like.

In FIG. 1, the printing medium conveying device 107 for conveying the printing medium 108 is configured by a printing medium feeding roller 107*a* and a printing medium winding roller 107*b* but may be able to convey a printing medium and thus is not particularly limited to the configuration.

Determination of Reaction Degree by Reaction Liquid

In this embodiment, a test pattern created by applying an ink a, and then applying an ink b different from the ink a onto the ink a is created, and then it is determined whether an aggregation reaction by a reaction liquid sufficiently proceeds. The determination may be automatically performed using a reading device mounted in an ink jet printing apparatus or an external reading device or may be performed by visually observing the test pattern, and then inputting information on the determined result into an ink jet printing apparatus by a user. The following example describes an example of creating a pattern on the transfer body 101.

Figure 8A:
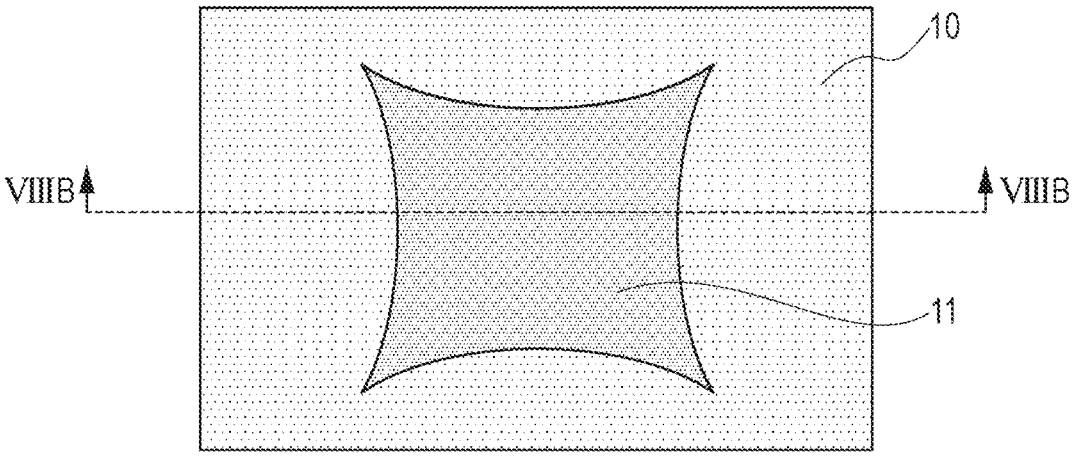
FIGS. 8A and 8B each are schematic views illustrating an example of a test pattern according to one embodiment of the disclosure.
Figure 8B:
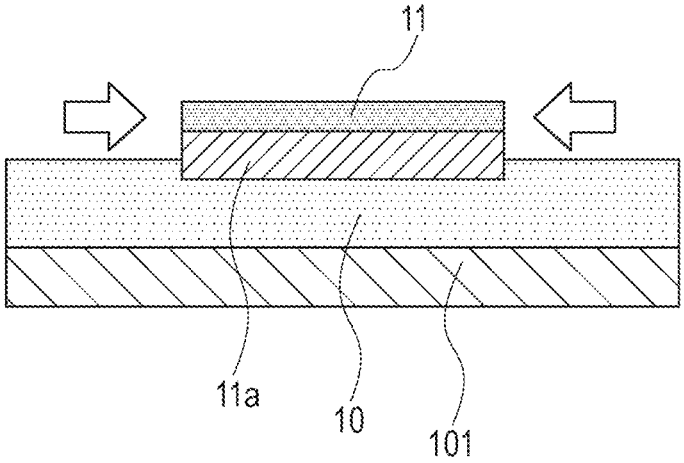
Figure 9A:
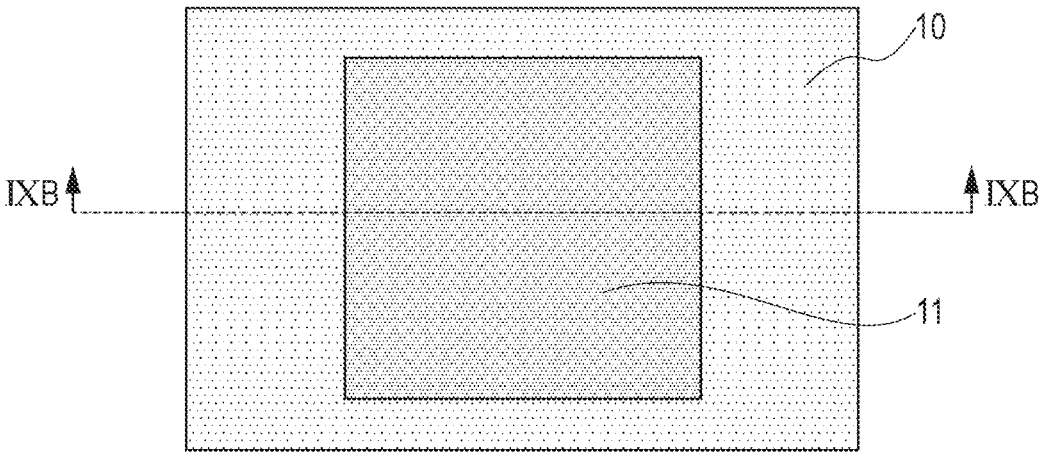
FIGS. 9A and 9B each are schematic views illustrating an example of a test pattern according to one embodiment of the disclosure.

An example of the test pattern is illustrated in FIGS. 8A and 8B and FIGS. 9A and 9B. In the examples of FIGS. 8A and 8B and FIGS. 9A and 9B, images obtained by applying 20 $g/m^2$ of an ink 11 in a rectangular shape were used as the test patterns. FIG. 8A is a schematic view when the test pattern on the transfer body 101 is viewed from above in the case where the reaction liquid 10 is excessive. FIG. 9A is a schematic view when the test pattern on the transfer body 101 is viewed from above in the case where the reaction liquid 10 is appropriate.

FIG. 8B is a schematic view of a cross-sectional view along the VIIIB-VIIIB line of FIG. 8A. As illustrated in FIGS. 8A and 8B, when the application amount of the reaction liquid 10 is excessive, the ink 11 and an ink reactant 11*a* are likely to move on the reaction liquid 10, so that a phenomenon in which particularly image end portions are distorted occurs.

Next, the presumed mechanism in which an image moves is described. When the ink 11 is applied onto the reaction liquid 10, the reaction liquid 10 and the ink 11 react with each other, so that the ink reactant 11*a* in which the viscosity has rapidly increased as compared with that of the ink 11 is generated. However, when the reaction liquid 10 excessively remains as illustrated in FIGS. 8A and 8B, the ink 11 and the ink 11*a* are unstable on the reaction liquid 10. When the ink reactant 11*a* is generated from the ink 11, the ink reactant 11*a* is in a state of being likely to shrink by a reaction.

In the case of the rectangular image, the drying of moisture specifically quickly proceeds at the tops thereof. Therefore, even when the reaction liquid 10 is excessively present, the tops are easily pinned on the transfer body 101. The tops of the rectangular image are pinned, and therefore side portions of the rectangular image move with the image shrinkage, and, as a result, a distorted image of FIG. 8A is formed. It is considered that the same tendency applies to polygonal shapes having tops and sides including a triangular shape and a quadrangular shape. An image of a triangular shape in place of a rectangular shape may be used. When the shape changes by the movement of images can be recognized, images can be formed into other geometrical shapes, such as a circular shape.

Figure 9B:
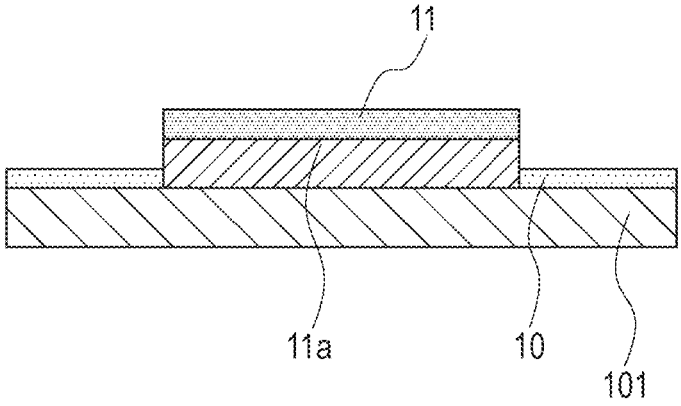

FIG. 9B is a schematic view of a cross-sectional view along the IXB-IXB line of FIG. 9A. When the application amount of the reaction liquid 10 is appropriate as illustrated in FIGS. 9A and 9B, the ink 11 and the ink reactant 11*a* do not move on the reaction liquid 10 and, even when the reaction liquid 10 and the ink 11 tend to react with each other to cause image shrinkage, a stable state can be maintained. Therefore, the same rectangular image as an input image can be output without causing distortion of end portions of the image as illustrated in FIG. 9A.

Subsequently, a determination method of the test pattern is described. In the states illustrated in FIGS. 8A and 8B and FIGS. 9A and 9B, the areas of the images are different from each other, and therefore it can be determined whether the application amount of the reaction liquid 10 is appropriate by measuring the patterns with a sensor. Changes may be determined by measuring the positions of the sides of the polygonal shape with a line sensor. As the sensor, when the pattern on the transfer body 101 is read immediately after the pattern formation, a sensor 1*a* provided immediately downstream of the ink application device 104 in the rotation direction of the transfer body 101 as illustrated in FIG. 1 can be utilized. When the pattern after transferred to paper is read with a sensor, a sensor 1*b* similarly illustrated in FIG.

1 can be utilized. For the sensors 1*a* and 1*b*, a line sensor or a colorimeter can be utilized. The areas of dots of the ink 11*b* applied to the upper side in the test patterns are reflected on the density and the color. Therefore, the determination can also be performed by comparing the density or the color optically detected using the sensors 1*a* and 1*b* with a predetermined threshold value. In this case, a printer control portion 303 receives detection signals of the test patterns from the sensors 1*a* and 1*b*, and then the determination may be performed by comparing the detection signals with a predetermined threshold value in a CPU 401, for example.

An ideal image illustrated in FIGS. 9A and 9B may be prepared beforehand as a reference image, and then the determination may be performed by visually comparing a printed pattern with a reference pattern by a user.

Figure 10:
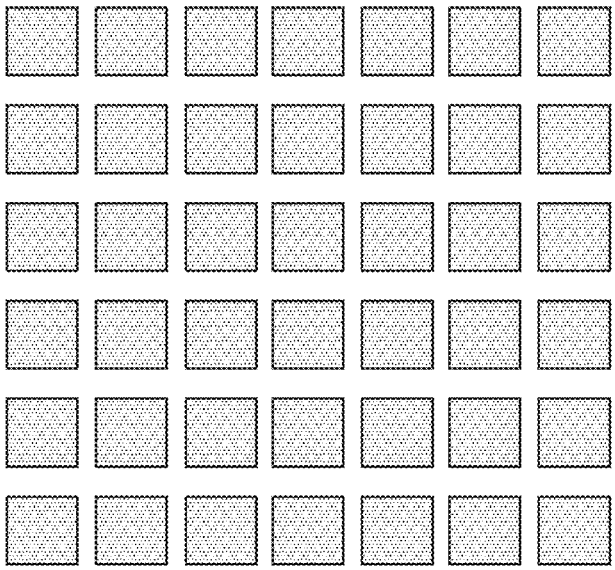
FIG. 10 is a schematic view illustrating an example of a test pattern according to one embodiment of the disclosure.
Figure 11:
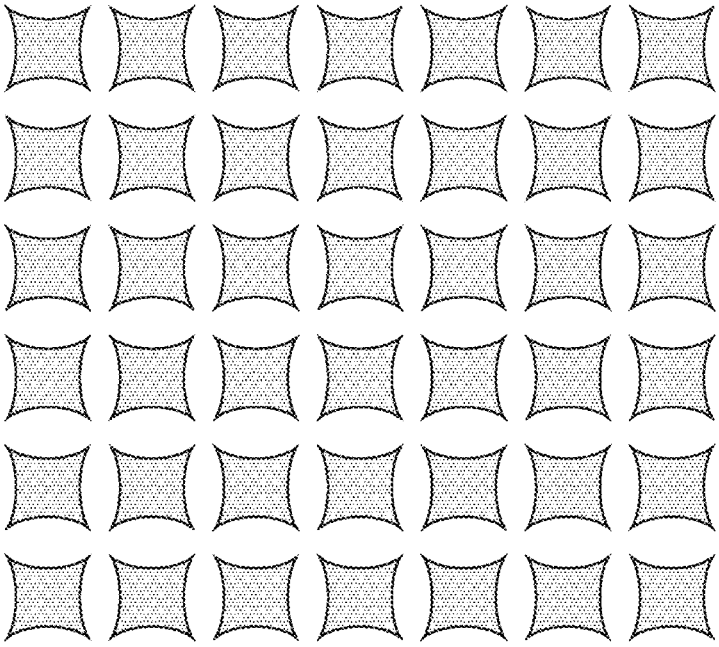
FIG. 11 is a schematic view illustrating an example of a test pattern according to one embodiment of the disclosure.

As the test pattern, an image in which rectangular images are arranged as illustrated in FIG. 10 can also be used. When the reaction liquid is excessively applied, images with a low density are output per unit area including a plurality of rectangular images as illustrated in FIG. 11 to the input image illustrated in FIG. 10. On the other hand, when the reaction liquid is appropriately applied, the image as illustrated in FIG. 10 is obtained. This image can be prepared beforehand as a reference image, and then the densities of the reference image and an output image can also be visually compared. In this embodiment, the application amount of the ink 11 is set to 20 g/m$^2$ in the test pattern but the application amount is not particularly limited.

Example Control System

Figure 3:
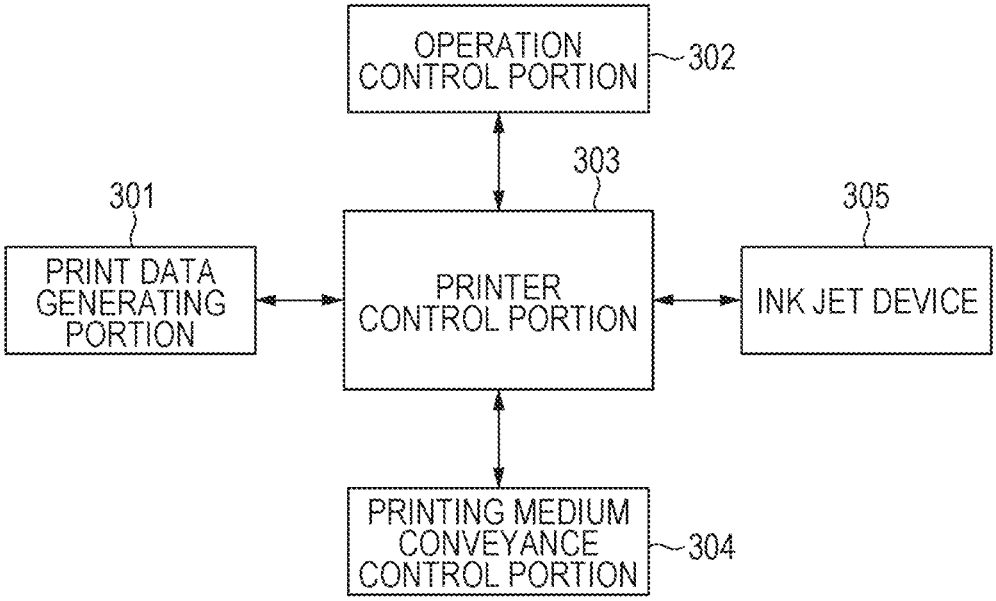
FIG. 3 is a block diagram illustrating an example control system of the entire apparatus in the ink jet printing apparatus illustrated in each of FIGS. 1 and 2.

The transfer type ink jet printing apparatus 100 in this embodiment has a control system controlling each device. FIG. 3 is a block diagram illustrating a control system of the entire apparatus in the transfer type ink jet printing apparatus 100 illustrated in FIG. 1.

In FIG. 3, the reference numeral 301 denotes a print data generating portion, such as an external print server, the reference numeral 302 denotes an operation control portion, such as an operation panel, and the reference numeral 303 denotes a printer control portion for performing a printing process. The reference numeral 304 denotes a printing medium conveyance control portion for conveying a printing medium and the reference numeral 305 denotes an ink jet device for performing printing, which corresponds to the ink application device 104 of FIG. 1.

Figure 4:
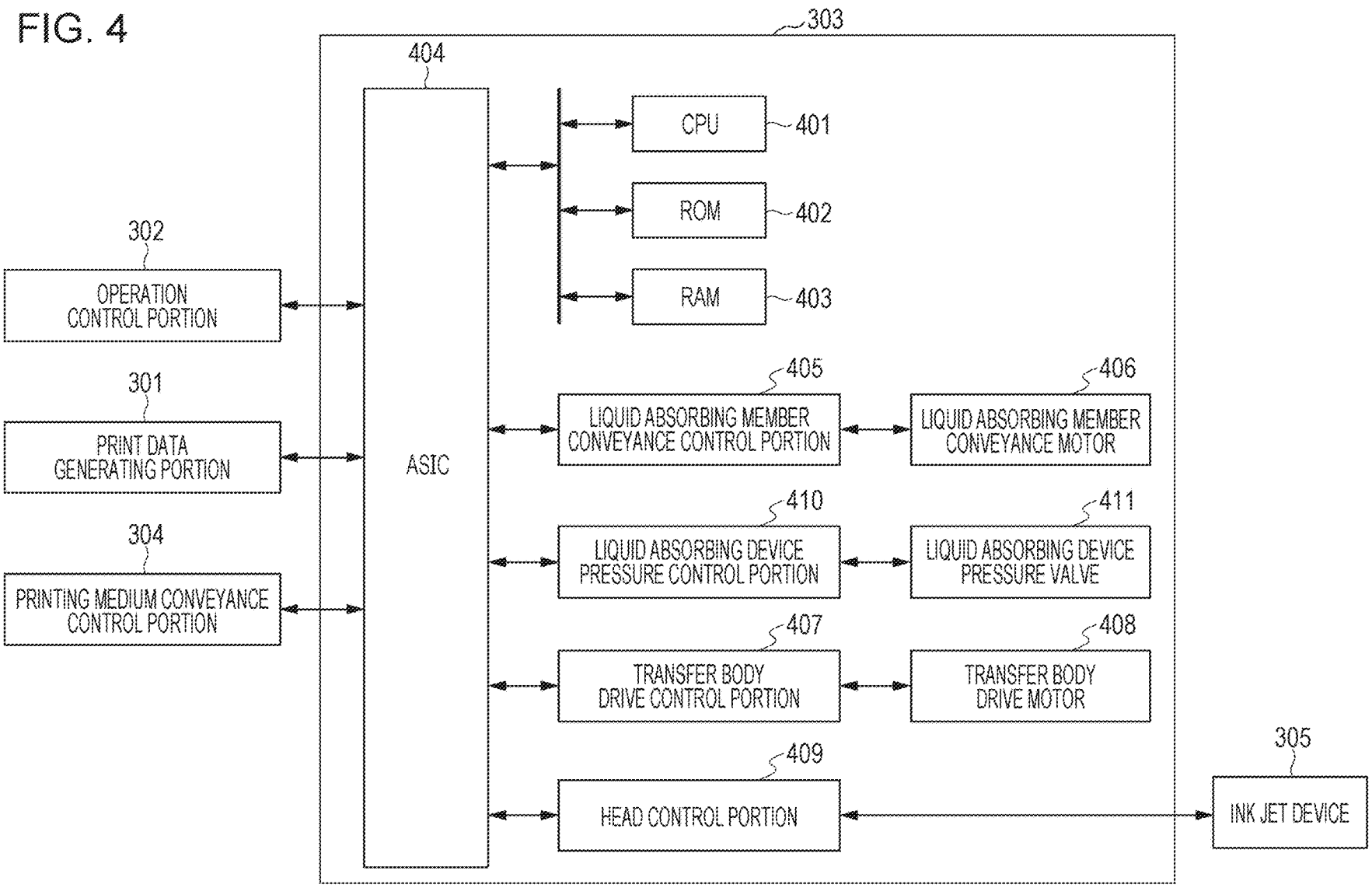
FIG. 4 is a block diagram of a printer control portion in the transfer type ink jet printing apparatus illustrated in FIG. 1.

FIG. 4 is a block diagram of the printer control portion 303 in the transfer type ink jet printing apparatus 100 of FIG. 1.

The reference numeral 401 denotes the CPU controlling the entire printer, the reference numeral 402 denotes a ROM for storing a control program of the CPU 401, and the reference numeral 403 denotes a RAM for executing a program. The reference numeral 404 denotes an integrated circuit for specific application (Application Specific Integrated Circuit: ASIC) in which a network controller, a serial IF controller, a controller for generating head data, a motor controller, and the like are built. The reference numeral 405 denotes a liquid absorbing member conveyance control portion for driving a liquid absorbing member conveyance motor 406 and is command-controlled through the serial IF from the ASIC 404. The reference numeral 407 denotes a transfer body drive control portion for driving a transfer body drive motor 408, which is similarly command-controlled through the serial IF from the ASIC 404. The reference numeral 409 denotes a head control portion, which performs final discharge data generation, drive voltage generation, and the like of an ink jet device 305.

In this embodiment, in order to prevent a solid content in an insufficiently aggregated ink from moving to the liquid absorbing member 105*a* when a test pattern is created, the transfer body 101 and the liquid removing device 105 can also be moved relatively to each other to be separated from each other. This is effective as a countermeasure when the amount of the reaction liquid to be applied is small, and thus the aggregation becomes insufficient. The reference numeral 410 denotes a liquid absorbing device pressure control portion for controlling a liquid absorbing device pressure valve 411 and is command-controlled through the serial IF from the ASIC 404. Using the liquid absorbing device pressure control portion 410, the liquid removing device 105 can be separated from the transfer body 101 in a determination mode for the reaction liquid application amount and the liquid removing device 105 can be caused to abut on the transfer body 101 in a usual printing mode.

Next, the operation procedure in the ink jet printing apparatus 100 of this embodiment is described in detail with reference to FIG. 1 and FIG. 7.

Figure 7:
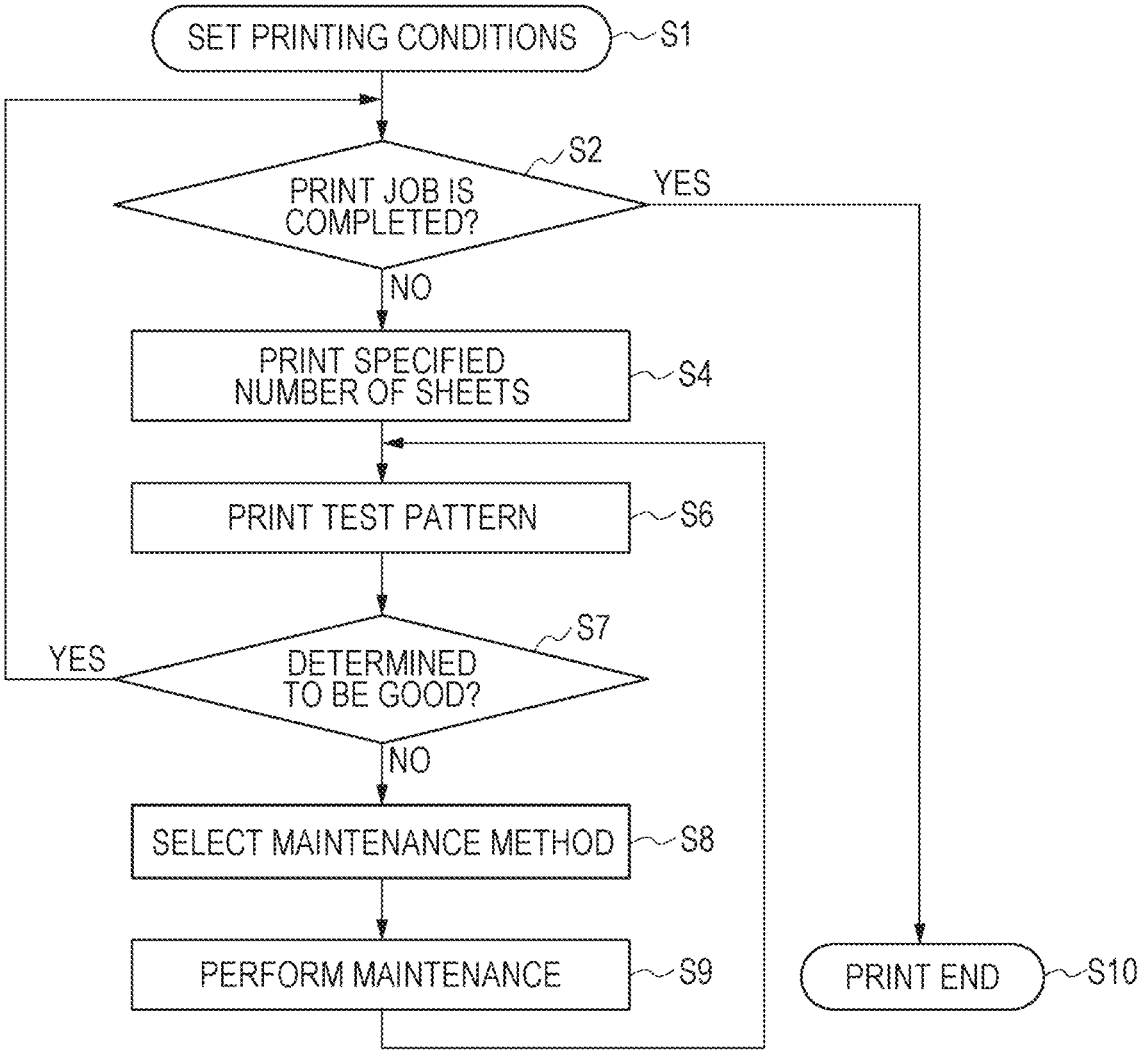
FIG. 7 is a flow chart of the sequence performed by the printing apparatus in one embodiment of the disclosure.

FIG. 7 is a flow chart illustrating the flow of the printing operation of the ink jet printing apparatus 100 in this embodiment. When the apparatus 100 is started to start printing, the ASIC 404 first receives information on the print settings (total number of printed sheets, print sheet type, print image, test pattern, specified number of sheets) input by a user through the operation control portion 302 in printing condition setting of Step S1. The CPU 401 moves the information to the RAM 403 from the ASIC 404, and then stores the same therein. The current number of printed sheets is printed in the RAM 403. The CPU 401 counts up the current number of printed sheets when the number of printed sheets increases by one sheet.

Subsequently, in Step S2, the CPU 401 compares the current number of printed sheets and the total number of printed sheets stored in the RAM 403, and then, when the current number of printed sheets is larger, the process proceeds to Step S10 to cause the ink jet printing apparatus 100 to end the printing.

When the current number of printed sheets is smaller, the process proceeds to Step S3. In Step S3, the CPU 401 gives instruction to the ASIC 404, controls the liquid absorbing device pressure valve 411 through the liquid absorbing device pressure control portion 410, moves the liquid removing device 105, and then brings the liquid absorbing member 105*a* into contact with the transfer body 101. In the subsequent Step S4, according to the information stored in the ROM 402, an instruction is given from the CPU 401 so as to print a print image by only specified number of sheets according to the information stored in the ROM 402. Step S3 and Step S4 are in usual printing modes. In the usual printing mode, the liquid absorbing member 105*a* and the transfer body 101 contact each other as illustrated in FIG. 1, and thus liquid absorption is in an effective state. When the printing of the specified number of sheets is completed in Step S4, the process proceeds to a mode for determining the application amount of a reaction liquid.

Step S6 and Step S7 are in determination modes of the application amount of the reaction liquid. Then, Step S8 and Step S9 are in maintenance modes accompanying the determination modes.

In the following Step S6, by an execution instruction by the CPU 401, the ASIC 404 receiving the instruction causes the ink jet device 305 to print a test pattern stored in the ROM 402 using the head control portion 409.

Subsequently, in Step S7, the test pattern is read with the sensor 1*b* illustrated in FIG. 1, and then the determination is performed based on the read image data. The test pattern on the transfer body 101 can be read with the sensor 1*a*, and then determined with the printer control portion 303. The density and the like of the read results are notified to a user through the operation control portion 302, and then the process proceeds to the maintenance described later by an instruction from the user or the process may proceed to the maintenance by receiving an input from a user visually observing the printed test pattern.

For the sensors 1*a* and 1*b*, line type sensors, such as CCD and CIS, are usable. The color may also be measured with a colorimetric sensor.

In Step S7, when the determination result is good, i.e., it is determined that the application amount of the reaction liquid is not excessively large, the process proceeds to Step S2 of printing the specified number of sheets again, and then it is determined whether the printing is completed. On the other hand, in Step S7, when it is determined that the application amount of the reaction liquid is excessively large, a user is informed of the necessity of the maintenance, and then the process proceeds to Step S8 of selecting the maintenance method. Herein, the user performs an input about the device of the ink jet printing apparatus 100 to be subjected to the maintenance through the operation control portion 302 in order to improve the reactivity, e.g., returning the application amount of the reaction liquid to a sufficient amount and the like, and then the process enters the maintenance mode described later.

Subsequently, the process proceeds to Step S9 of performing the maintenance. In Step S9, the maintenance of various devices is performed, and then, after performing the maintenance, an instruction for the process to proceed to Step S6 is input through the operation control portion 302. The maintenance can be automatically performed by the ink jet printing apparatus 100 but may be manual maintenance by a user. Then, in Step S6, a test pattern is printed again, and then it is determined again whether the determination result is "O.K." in Step S7.

By performing the determination of the application amount of the reaction liquid for every specified number of sheets according to the sequence, the image quality can be maintained. In addition to performing the steps from S3 to S9 for every printing of the specified number of sheets, the steps may be performed after the printing is temporarily stopped and the apparatus is stopped, and then the printing is started again. At this time, the CPU 401 of the printer control portion 303 may determine the execution, but a user may input an execution instruction through the operation control portion 302.

Maintenance of Device

Subsequently, the maintenance about the reaction liquid 10 in the ink jet printing apparatus 100 is described. As illustrated in FIGS. 8A and 8B, when the application amount of the reaction liquid 10 is large, the maintenance of various devices is performed in order to reduce the application amount of the reaction liquid 10. Next, the maintenance device performed in this embodiment is described in detail.

Maintenance of Reaction Liquid Application Device

In the reaction liquid application device 103, the application amount of the reaction liquid 10 increases due to a trouble of the reaction liquid application member 103*b* in some cases. Or, the application amount of the reaction liquid 10 increases due to excessive high pressure between the reaction liquid application member 103*c* and the transfer bodies 101 in some cases. In such a case, the maintenance, such as cleaning of the reaction liquid application device 103*b*, or the adjustment for reducing the pressure between the reaction liquid application member 103*c* and the transfer body 101 is performed.

Maintenance of Transfer Body

The ease of movement of the image on the reaction liquid 10 may vary with a change in the surface state of the transfer body 101 due to continuous use as a factor. In such a case, the surface state of the transfer body 101 is confirmed, and then the transfer body 101 is exchanged as necessary. On the other hand, when dirt adheres to the transfer body 101, the operation of a transfer body cleaning device is confirmed, and then the maintenance by the transfer body cleaning member 109 is performed as necessary. When the surface state of the transfer body 101 varies in a direction where an ink image is likely to flow, the transfer body 101 may be exchanged.

FIG. 1 illustrates a system in which the reaction liquid application device 103 performs application with a roller but a system of performing the application with an ink jet head may be acceptable. The use of the system of performing the application with an ink jet head can achieve on-demand control of the application amount of the reaction liquid. For example, a plurality of test patterns containing a plurality of patches different in the application amount of the reaction liquid 10 are printed at once, the test pattern of an appropriate application amount of the reaction liquid 10 is selected therefrom, and then the application amount of the reaction liquid 10 in usual printing can be changed to the application amount of the reaction liquid 10 when the selected pattern is formed.

Example Direct Drawing Type Ink Jet Printing Apparatus

As another embodiment in this embodiment, a direct drawing type ink jet printing apparatus is mentioned. In the direct drawing type ink jet printing apparatus, a discharge medium is a printing medium on which an image is to be formed.

Figure 2:
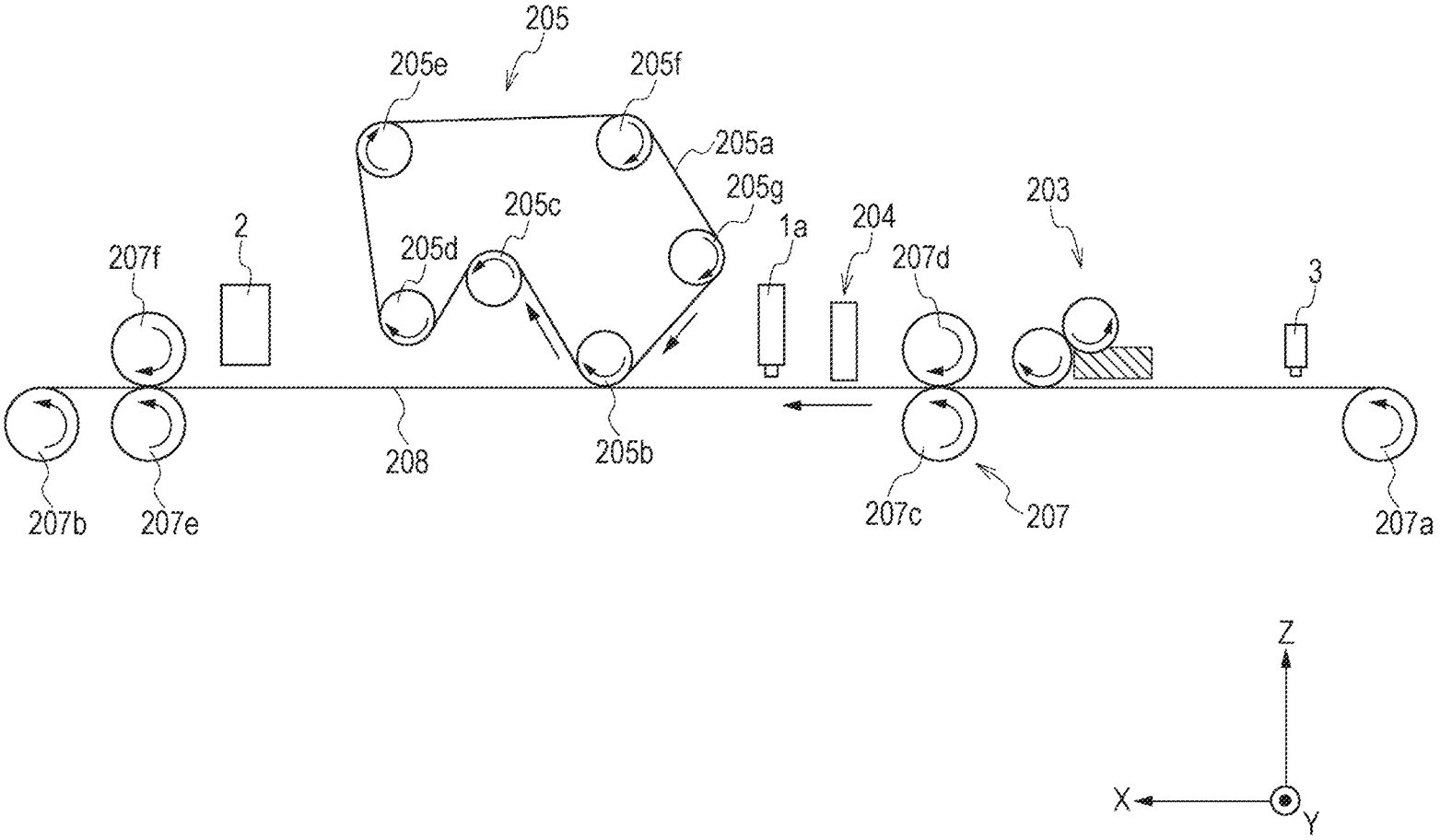
FIG. 2 is a schematic view illustrating an example of the configuration of a direct drawing type ink jet printing apparatus according to one embodiment of the disclosure.

FIG. 2 is a schematic view illustrating an example of the schematic configuration of a direct drawing type ink jet printing apparatus 200 in this embodiment. As compared with the transfer type ink jet printing apparatus 100 described above, the direct drawing type ink jet printing apparatus 200 has the same units as those of the transfer type ink jet printing apparatus 100, except not having the transfer body 101, the support member 102, and the transfer body cleaning member 109 and forming an image on a printing medium 208.

A reaction liquid application device 203 applying a reaction liquid to the printing medium 208 and an ink application device 204 applying an ink to the printing medium 208 have the same configuration as that of the transfer type ink jet printing apparatus 100, and thus descriptions thereof are omitted. A liquid absorbing member 205*a* contacting an ink image on the printing medium 208 and a liquid absorbing device 205 removing a liquid component contained in the ink image also have the same configuration as that of the transfer type ink jet printing apparatus 100, and thus descriptions thereof are omitted.

In the direct drawing type ink jet printing apparatus 200 of this embodiment, the liquid absorbing device 205 has the liquid absorbing member 205*a* and a pressing member 205*b* for liquid absorption pressing the liquid absorbing member 205*a* against an ink image on the printing medium 208. The shapes of the liquid absorbing member 205*a* and the pressing member 205*b* are not particularly limited and those having the same shapes as the shapes of the liquid absorbing member 105*a* and the pressing member 106 usable in the transfer type ink jet printing apparatus 100 are usable. The liquid absorbing device 205 may have a stretching member stretching the liquid absorbing member 205*a*. In FIG. 2, the reference numerals 205*c*, 205*d*, 205*e*, 205*f*, and 205*g* denote stretching rollers as the stretching member. The number of the stretching rollers is not limited to five of FIG. 4, and a required number of the stretching rollers may be disposed according to the design of the apparatus. Moreover, an ink application portion applying an ink to the printing medium 208 by the ink application device 204 and a liquid component removal portion removing a liquid component from an ink image may be provided with a printing medium support member (not illustrated) supporting the printing medium 208 from below.

Example Printing Medium Conveying Device

In the direct drawing type ink jet printing apparatus 200 of this embodiment, a printing medium conveying device 207 is not particularly limited and a conveyance unit in a known direct drawing type ink jet printing apparatus is usable. As an example, a printing medium conveying device having a printing medium feeding roller 207*a*, a printing medium winding roller 207*b*, and printing medium conveyance rollers 207*c*, 207*d*, 207*e*, and 207*f* as illustrated in FIG. 2 is mentioned.

Example Control System

The direct drawing type ink jet printing apparatus 200 in this embodiment has a control system controlling each device. A block diagram illustrating a control system of the entire apparatus in the direct drawing type ink jet printing apparatus 200 illustrated in FIG. 2 is as illustrated in FIG. 3 as with the transfer type ink jet printing apparatus 100 illustrated in FIG. 1.

Figure 5:
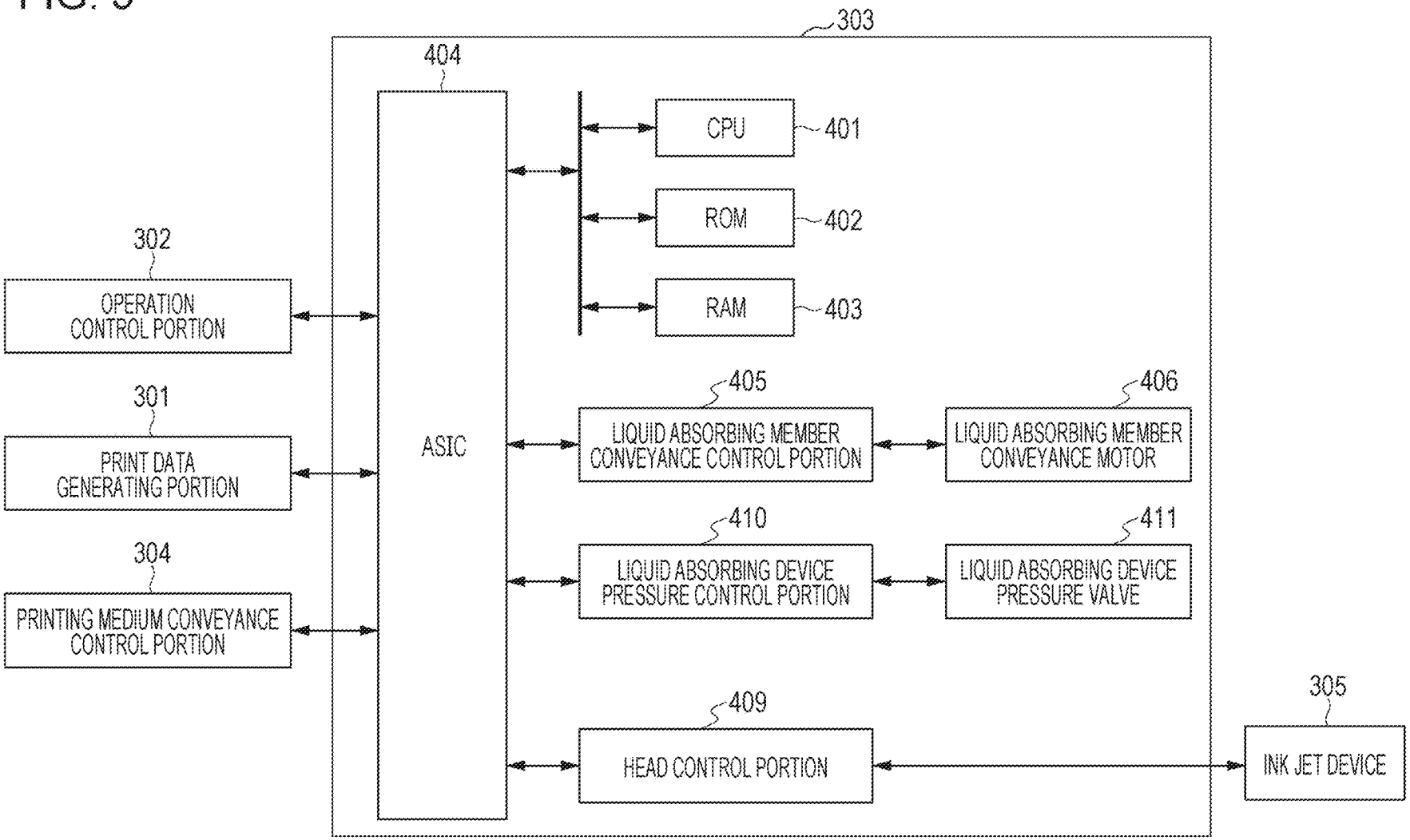
FIG. 5 is a block diagram of a printer control portion in the direct drawing type ink jet printing apparatus illustrated in FIG. 2.

FIG. 5 is a block diagram of a printer control portion in the direct drawing type ink jet printing apparatus 200 of FIG. 2. The block diagram is equivalent to the block diagram of the printer control portion 303 in the transfer type ink jet printing apparatus 100 in FIG. 4, except not having the transfer body drive control portion 407 and the transfer body drive motor 408.

In the case of the direct drawing type ink jet printing apparatus 200, the liquid absorbing device pressure control portion 410 has a function of separating the liquid absorbing device 105 from the printing medium 208. The ink jet device 305 corresponds to the ink application device 204.

Also in the direct drawing type ink jet printing apparatus 200, printing, the determination of the application amount of a reaction liquid, and maintenance can be performed according to the sequence illustrated in FIG. 7. However, the direct drawing type ink jet printing apparatus 200 is different from the transfer type ink jet printing apparatus 100 in that Step S3 is in a stage of causing the liquid absorbing device 205 and the printing medium 208 to abut on each other and Step S5 is in a stage of separating the liquid absorbing device 205 and the printing medium 208. FIG. 11 is a schematic view when the liquid absorbing device 205 is separated from the printing medium 208 in determining the reaction liquid application amount.

EXAMPLES

Hereinafter, the embodiments are described in more detail with reference to Examples. The disclosure is not limited at all by the following examples without deviating from the gist. In the description of the following examples, "part(s)" are on a mass basis unless otherwise particularly specified.

A test pattern of the application amount of a reaction liquid was printed as follows using the apparatus 100 of FIG. 1.

First, as a reaction liquid applied by the reaction liquid application unit 103, one having the following composition was used.

Glutaric acid 21.0 parts

Glycerol 5.0 parts

Surfactant (Product Name: Megafac F444, manufactured by DIC Corporation) 5.0 parts Ion Exchanged Water Balance An ink was prepared as follows.

Preparation of Pigment Dispersion

Preparation of Black Pigment Dispersion Liquid 10 parts of carbon black (Product Name: Monarch 1100, manufactured by Cabot Corporation), 15 parts of a resin aqueous solution (obtained by neutralizing an aqueous solution of a styrene-ethyl acrylate-acrylic acid copolymer having an acid value of 150, a weight average molecular weight (Mw) of 8,000, and a resin content of 20.0% by mass with a potassium hydroxide aqueous solution), and 75 parts of pure water were mixed, and then charged into a batch type vertical sand mill (manufactured by AIMEX CO., Ltd.). Then, 200 parts of zirconia beads having a diameter of 0.3 mm was charged thereinto, and then the mixture was dispersed for 5 hours under water cooling. The dispersion liquid was centrifuged to remove coarse particles, and then a black pigment dispersion having a pigment content of 10.0% by mass was obtained. Preparation of cyan pigment dispersion liquid A cyan pigment dispersion liquid was prepared in the same manner as the preparation of the black pigment dispersion liquid, except replacing the 10 parts carbon black used in the preparation of the black pigment dispersion liquid with 10% C.I.

Pigment Blue 15:3.

Preparation of Resin Particle Dispersion 20 parts of ethyl methacrylate, 3 parts of 2,2'-azobis-(2-methylbutyronitrile), and 2 parts of n-hexadecane were mixed, and then stirred for 0.5 hour. The mixture was added dropwise to 75 parts of a 8% aqueous solution of a styrene-butyl acrylate-acrylic acid copolymer (Acid value: 130 mgKOH/g, Weight average molecular weight (Mw): 7,000), and then stirred for 0.5 hour. Next, ultrasonic waves were emitted with an ultrasonic irradiation machine for 3 hours. Subsequently, a polymerization reaction was performed at 80° C. for 4 hours under a nitrogen atmosphere, and then filtered after reducing the temperature to room temperature to prepare a resin particle dispersion having a resin content of 25.0% by mass.

Preparation of Ink

The resin particle dispersion and the pigment dispersion obtained above were mixed with the following components. The balance of the ion exchanged water is the amount set so that the total of all the components configuring an ink is 100.0% by mass.

Pigment dispersion (The content of a coloring material is 10.0% by mass.) 40.0% by mass Resin particle dispersion 20.0% by mass Glycerol 7.0% by mass Polyethylene glycol (Number average molecular weight (Mn): 1,000) 3.0% by mass Surfactant: Acetylenol E100 (manufactured by Kawaken Fine Chemicals Co., Ltd.) 0.5% by mass Ion Exchanged Water Balance The substances were sufficiently stirred, and then filtered under pressure with a microfilter (manufactured by Fuji Photo Film Co., Ltd.) having a pore size of 3.0 μm to prepare a black ink and a cyan ink.

For the ink application unit 104, an ink jet head of a type of discharging an ink by an on-demand system using an electrothermal conversion element was used.

The printing medium 108 is conveyed by the printing medium feeding roller 107*a* and the printing medium winding roller 107*b* in such a manner as to have the same speed as the movement speed of the transfer body 101. In this example, the conveyance speed was set to 0.5 m/s and an aurora coated paper (manufactured by Nippon Paper Industries Co., Ltd., Basis weight of 128 g/m$^2$) was used as the printing medium 108.

Subsequently, a principal portion of Examples is described in detail with reference to the drawings.

Figure 6A:
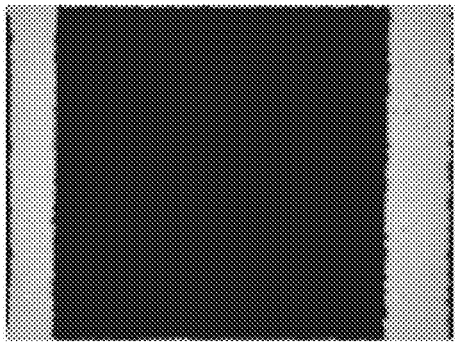
FIGS. 6A to 6C each are views illustrating the state of a test pattern in one embodiment of the disclosure.
Figure 6B:
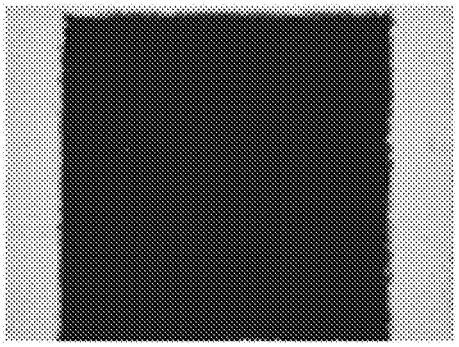
Figure 6C:
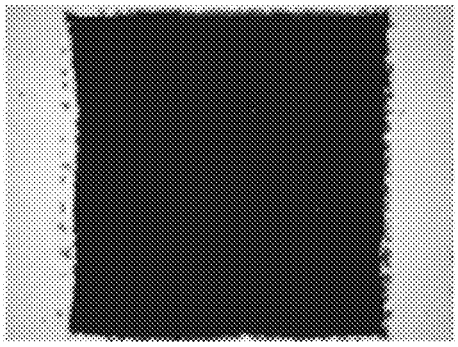

FIGS. 6A to 6C each illustrate an example of a test pattern of a reaction liquid when the coating amount of the reaction liquid in Examples is intentionally varied. Next, a method for creating the test patterns illustrated in FIGS. 6A to 6C is described.

In the ink jet printing apparatus 100 illustrated in FIG. 1, a reaction liquid was coated with the reaction liquid application device 103 onto the transfer body 101, and then an ink was applied onto the coated reaction liquid with the ink application device 104 to form a test pattern. In Examples, a pattern of the test pattern was formed into a 2 mm square and the temperature of the transfer body 101 was set to 60° C. Subsequently, the test pattern was imaged with the sensor 1*a*. FIG. 6A illustrates a result of printing an excessive coating determining image with the ink application device 104 after applying a 0.5 g/m$^2$ of the reaction liquid with the reaction liquid application device 103. Herein, the coating amount of the reaction liquid of 0.5 g/m$^2$ is the weight of the reaction liquid measured by a gravimetric method after sufficiently drying water. Similarly, the reaction liquid coating amount of FIG. 6B was 0.64 g/m$^2$ and the reaction liquid coating amount of FIG. 6C was 0.82 g/m$^2$. When the three images of FIGS. 6A, 6B, and 6C are compared, FIGS. 6A and 6B keep the same square shape as that of the input image but, in the image of FIG. 6C, the square sides are distorted. This is considered to be because the image slid on the reaction liquid due to excessive coating of the reaction liquid, and thus the image moved. More specifically, the image quality on the transfer body 101 correlates with the coating amount of the reaction liquid. By controlling the coating amount of the reaction liquid, the image quality of a product can be controlled. In order to detect the coating amount of the reaction liquid, the sensor 1*a* was used. However, the average brightness of a square portion may be measured with a colorimeter 1*a* to detect the deformation of an excessive coating determining image based on a difference in average brightness. The colorimeter or the line sensor may be disposed at the position of 1*a* immediately after the image formation or may be disposed at the position of 1*b* after removing liquid of an image with the liquid removing device 105. In the transfer type ink jet printing apparatus 100, the heating device 2 can be used in order to further dry moisture remaining in the case of the liquid removing device 105. When an infrared heating system is used as the heating device 2, effects of an image portion and a non-image portion or color differences can be reduced by compounding carbon black in the transfer body 101. In this case, when the colorimeter or the line sensor is disposed at the position 1*c* after transferring an image to the printing medium 108, the measurement can be performed with high accuracy in some cases than the accuracy when an image on the transfer body 101 is imaged or the brightness thereof is measured with the colorimeter or the sensors 1*a* and 1*b*. This is effective for a case where the transfer body 101 is black and the measurement on the transfer body 101 is difficult. FIG. 1 illustrates a system in which the reaction liquid application device 103 performs the coating with a roller but a system of performing the application with an ink jet head may be acceptable. The use of the system of performing the application with the ink jet head can achieve on-demand control of the coating amount of the reaction liquid.

The disclosure can correctly detect the degree of an aggregation reaction by a reaction liquid.

While the disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-207961 filed Oct. 27, 2017, which is hereby incorporated by reference herein in its entirety.

What is claimed is:

1. A printing apparatus comprising:

a reaction liquid application unit applying a reaction liquid onto a discharge medium;

an ink application unit applying an ink containing a solid content to be aggregated by reacting with the reaction liquid onto the reaction liquid applied onto the discharge medium; and an adjustment unit adjusting an amount of the reaction liquid to be applied to the discharge medium by the application unit, wherein for the adjustment of the amount of the reaction liquid to be applied to the discharge medium using the adjustment unit, a determination mode for determining an application amount of the reaction liquid onto the discharge medium is performed, in the determination mode, the reaction liquid application unit forms a layer of the reaction liquid on the discharge medium, and then the ink application unit applies the ink onto a part of the layer to form a test pattern to be utilized for the determination, and, in the formation of the test pattern, an image formed by the ink, by aggregation of the solid content in the applied ink, partially moves and shrinks on the layer of the reaction liquid, whereby the image is deformed with a degree corresponding to the amount of the reaction liquid in the layer of the reaction liquid.

2. The printing apparatus according to claim 1, wherein the test pattern of a rectangular shape is formed by the ink application unit.

3. The printing apparatus according to claim 1, wherein the test pattern of a circular shape is formed by the ink application unit.

4. The printing apparatus according to claim 1, wherein the test pattern contains a plurality of patches.

5. The printing apparatus according to claim 1, wherein an operation for reducing the application amount of the reaction liquid to the discharge medium is performed in response to an input relating to the formed test pattern.

6. The printing apparatus according to claim 1 further comprising:

a reading unit reading the formed test pattern; and a unit performing processing relating to the reaction liquid according to a reading result by the reading unit.

7. The printing apparatus according to claim 1, wherein the reaction liquid application unit applies the reaction liquid to the discharge medium by coating the discharge medium with the reaction liquid.

8. The printing apparatus according to claim 1, wherein the discharge medium is a transfer body, and printing is performed by transferring an ink image formed by discharging an ink onto the transfer body to a printing medium.

9. The printing apparatus according to claim 8, wherein a surface to which the reaction liquid is applied of the transfer body is formed of resin.

10. A printing method comprising:

applying a reaction liquid onto a discharge medium;

applying an ink containing a solid content to be aggregated by reacting with the reaction liquid onto the reaction liquid applied onto the discharge medium; and adjusting an amount of the reaction liquid to be applied to the discharge medium, wherein in order to determine an application amount of the reaction liquid onto the discharge medium for adjusting an amount of the reaction liquid, a layer of the reaction liquid is formed on the discharge medium, and then the ink is applied onto a part of the layer to form a test pattern to be utilized for the determination, and, in the formation of the test pattern, an image formed by the ink, by aggregation of the solid content in the applied ink, partially moves and shrinks on the layer of the reaction liquid, whereby the image is deformed with a degree corresponding to the amount of the reaction liquid in the layer of the reaction liquid.

* * * * *